US007207635B2

(12) United States Patent
Simmons

(10) Patent No.: US 7,207,635 B2
(45) Date of Patent: Apr. 24, 2007

(54) JEWELRY DISPLAY CASE AND JEWELRY DISPLAY ASSEMBLY THEREFOR

(76) Inventor: Cindy Dawson Simmons, 6190 Westhaven Dr., Mechanicsville, VA (US) 23111

( * ) Notice: Subject to any disclaimer, the term of this patent is extended or adjusted under 35 U.S.C. 154(b) by 394 days.

(21) Appl. No.: 10/642,605

(22) Filed: Aug. 19, 2003

(65) Prior Publication Data

US 2005/0040741 A1 Feb. 24, 2005

(51) Int. Cl.
*A47F 3/00* (2006.01)

(52) U.S. Cl. ..... 312/125; 312/245; 206/6.1

(58) Field of Classification Search ..... 312/245, 312/242, 204, 114, 125, 128, 135; 206/6.1; D3/294; D6/449, 470
See application file for complete search history.

(56) References Cited

U.S. PATENT DOCUMENTS

| | | | | | |
|---|---|---|---|---|---|
| 92,619 | A | * | 7/1869 | Leonard | 312/117 |
| 618,887 | A | | 2/1899 | Levit | |
| 1,628,128 | A | * | 5/1927 | Dunn | 211/58 |
| 2,956,603 | A | * | 10/1960 | Maule | 221/69 |
| 2,962,156 | A | | 11/1960 | Adams | |
| 3,601,461 | A | * | 8/1971 | Melcher | 312/125 |
| 3,693,806 | A | * | 9/1972 | Lit et al. | 211/70 |
| 3,880,484 | A | * | 4/1975 | Sicina | 312/202 |
| D237,234 | S | | 10/1975 | Wertz | |
| 3,930,702 | A | | 1/1976 | Pichowicz | |
| 3,980,116 | A | * | 9/1976 | Edwards | 150/113 |
| 3,998,334 | A | * | 12/1976 | Smith | 211/45 |
| D251,166 | S | | 2/1979 | McIntosh | |
| 4,209,212 | A | | 6/1980 | McGoldrick | |
| 4,324,446 | A | | 4/1982 | LeSage | |
| 4,413,736 | A | | 11/1983 | Nibling | |
| 4,548,324 | A | * | 10/1985 | Mackey, Jr. | 211/58 |
| 4,776,650 | A | | 10/1988 | Ferenzi | |
| D305,479 | S | | 1/1990 | Williams | |
| 4,978,001 | A | | 12/1990 | Nelson | |
| 5,141,300 | A | | 8/1992 | Ciesla | |
| 5,172,814 | A | | 12/1992 | Pell et al. | |
| D333,222 | S | | 2/1993 | Ewing | |
| 5,242,048 | A | | 9/1993 | Ellingsworth et al. | |
| D346,520 | S | | 5/1994 | Baefield | |
| D346,695 | S | | 5/1994 | Williams | |
| D364,515 | S | | 11/1995 | Hou | |
| D368,583 | S | | 4/1996 | Sharer et al. | |
| 5,511,873 | A | | 4/1996 | Mech | |
| D372,391 | S | | 8/1996 | Anniballi | |
| 5,551,772 | A | | 9/1996 | Keffer | |
| 5,671,849 | A | | 9/1997 | Bacon | |
| 5,758,936 | A | | 6/1998 | Baughan | |
| D396,979 | S | | 8/1998 | Lawrence | |
| 5,931,319 | A | | 8/1999 | Murphy | |
| D418,348 | S | | 1/2000 | Thibadeau | |
| D430,755 | S | | 9/2000 | Simmons | |

* cited by examiner

*Primary Examiner*—James O. Hansen
(74) *Attorney, Agent, or Firm*—Nixon & Vanderhye P.C.

(57) ABSTRACT

A jewelry display case serves as artwork enabling a jewelry collection to form part of the artwork. The display case includes a cabinet having at least a bottom, sides and a top, and a plurality of jewelry supporting components. At least one of the jewelry supporting components includes a jewelry display assembly having a pair of sidewalls disposed spaced from each other in facing relation, at least one jewelry bar fixed to and extending between the sidewalls, and a supporting axle extending through a center of each of the sidewalls. The sidewalls and at least one jewelry bar are rotatable relative to the supporting axle. Additionally, the supporting axle is fixed to one of the cabinet sides. Other jewelry supporting components provide added functionality and artistic appeal.

12 Claims, 2 Drawing Sheets

JEWELRY DISPLAY CASE AND JEWELRY DISPLAY ASSEMBLY THEREFOR

CROSS-REFERENCES TO RELATED APPLICATIONS (Not applicable)

STATEMENT REGARDING FEDERALLY SPONSORED RESEARCH OR DEVELOPMENT (Not applicable)

BACKGROUND OF THE INVENTION

The present invention relates to a jewelry display case and, more particularly, to a jewelry display case including a rotatable jewelry display assembly.

Jewelry collections often contain many beautiful pieces, but practically only a certain number of pieces can be worn at one time. Conventionally, jewelry owners keep their jewelry in a jewelry box. This manner of keeping jewelry, however, does not permit the jewelry to be displayed.

BRIEF SUMMARY OF THE INVENTION

It would thus be desirable to provide a jewelry display case that serves not only as a means to store and organize a jewelry collection but also serves as artwork where the jewelry forms a part of the artwork. With the jewelry display case and jewelry display assembly of the invention, a jewelry owner can artistically display a jewelry collection within a sensible artwork cabinet.

In an exemplary embodiment of the invention, a jewelry display case includes a cabinet having at least a bottom, sides and a top, and a plurality of jewelry supporting components. At least one of the jewelry supporting components comprises a jewelry display assembly particularly suited for the cabinet. The jewelry display assembly includes a pair of sidewalls disposed spaced from each other in facing relation, and at least one jewelry bar fixed to and extending between the sidewalls. A supporting axle extends through a center of each of the sidewalls, wherein the sidewalls and the at least one jewelry bar are rotatable relative to the supporting axle. Additionally, the supporting axle is fixed to one of the cabinet sides.

The display assembly may include a plurality of jewelry bars fixed to and extending between the sidewalls, and in one embodiment, the plurality of jewelry bars are evenly spaced about each periphery of the sidewalls. The at least one jewelry bar preferably includes structure for supporting at least one piece of jewelry such as a plurality of apertures that are sized to receive earring posts. A handle assembly may be secured to one of the sidewalls and over the supporting axle, which handle assembly effects manual rotation of the axle.

The plurality of jewelry supporting components may also include a ring support including at least two adjacent flexible strip pads defining a flexible slot. In this context, the ring support may include at least three adjacent flexible strip pads defining two flexible slots. In one embodiment, the at least three adjacent flexible strip pads are stepped in height to provide a stepped ring display.

The jewelry supporting components may alternatively or additionally include a ring tower including at least one post for receiving a ring. In this context, the ring tower may include at least a stacked receiving component and a top receiving component, where the stacked receiving component includes a supporting member fixed to the cabinet or fixable to an adjacent stacked receiving component, a stacked ring platform, and a post with an aperture formed in a top thereof. The top receiving component may include a peg shaped to fit in the post aperture of an adjacent stacked receiving component, a top ring platform, and a respective post. In one arrangement, the ring tower includes a plurality of the stacked receiving components.

Preferably, the cabinet includes glass doors and possibly a lock.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
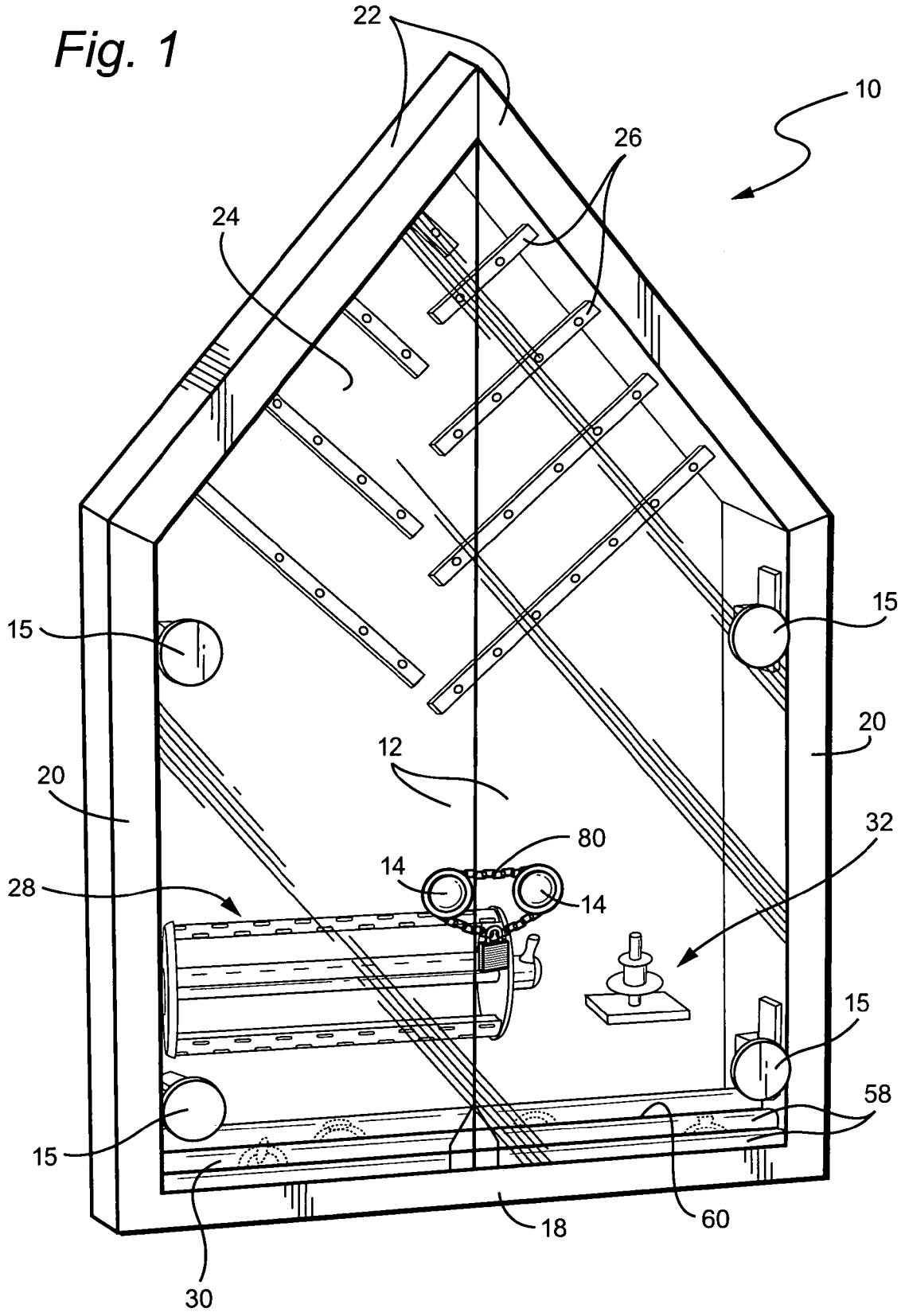
FIG. 1 is a perspective view of the jewelry display case of the present invention.

FIG. 1 is a perspective view showing a jewelry display case including exemplary jewelry supporting components. The jewelry display case 10 is configured for hanging on a wall or the like and includes glass doors 12 with respective handles 14 and hinges 15 such that the jewelry supported within the jewelry display 10 forms part of the assembled artwork.

The jewelry display case 10 generally includes a cabinet 16 having at least a bottom 18, sides 20 and a top 22. A back wall 24 may be covered with a decorative material such as felt or the like. As shown, the top 22 may be configured in an A-frame. Of course, other shapes of the cabinet 16 are suitable, and the invention is not meant to be limited to the illustrated example.

A plurality of jewelry supporting components are preferably mounted in the casing 16 on the back wall 24. Exemplary jewelry supporting components may include one or more necklace holders 26, an earring display assembly 28, a ring support 30, a ring tower 32 or the like. The jewelry supporting components can be arranged as desired however best to display the jewelry owner's collection, for example, by emphasizing one or more particularly important or decorative pieces of jewelry.

Figure 2:
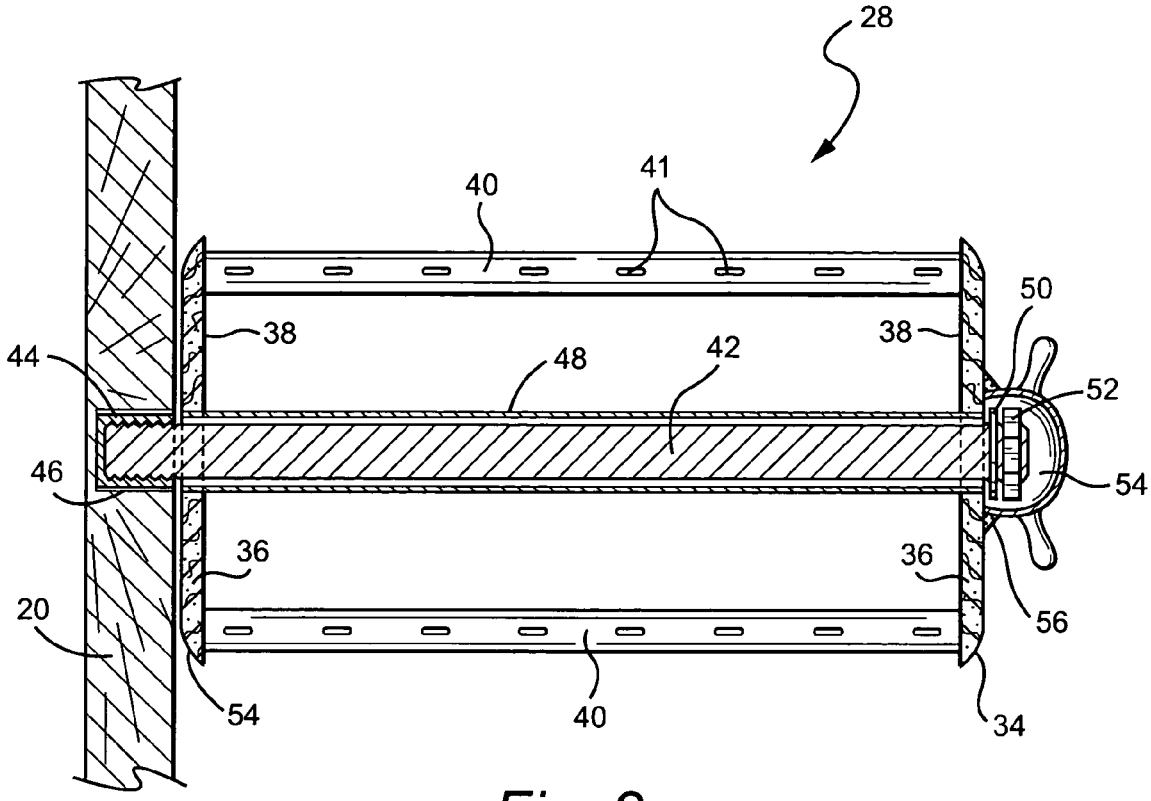
FIG. 2 illustrates an exemplary jewelry display assembly that is rotatable and is configured for supporting earrings.

FIG. 2 is an enlarged view of the earring display unit 28 for rotatably supporting earrings within the cabinet 16. The earring display assembly 28 preferably includes a pair of shaped sidewalls 34 disposed spaced from each other in facing relation. The shaped sidewalls 34 may be generally disk or plate-shaped, wherein a depth of the plate-shape may be filled with cardboard 36 or like material. A decorative felt covering 38 may be affixed over the cardboard filler 36.

At least one jewelry bar 40, preferably two or three, is fixed to and extends between the sidewalls 34. The jewelry bars 40 can be secured to the sidewalls 34 in any suitable manner, although in one preferred embodiment, the jewelry bars 40 are held by friction fit after being press fit through the decorative covering 38 and cardboard filler 36. The jewelry bars 40 are preferably provided with a plurality of apertures 41 sized for receiving earring posts.

A supporting axle 42 extends through a center of each of the sidewalls 34. The supporting axle 42 preferably comprises a threaded shaft that is securably threaded into a sleeve 44 affixed within a hole 46 in one of the cabinet sides 20. Once the supporting axle is firmly secured in the cabinet side 20, the sidewalls 34 and jewelry bars 40 may be slid over the shaft. A brass sleeve 48 is preferably fit over the supporting axle 42 to cover the supporting axle threads. The brass sleeve 48 may also be press fit through the decorative covering 38 and cardboard filler 36. Subsequently, on an opposite side of the outermost sidewall 34, a washer 50 and nut 52 are secured to the supporting axle 42 to keep the assembly in place. A handle 54 having a hollowed out center section is fit over the washer and nut assembly 50, 52 and secured via an adhesive 56 or other liquid weld to the outermost sidewall 34 as shown. In this manner, when the handle 54 is rotated, the sidewalls 34 and jewelry bars 40 are caused to rotate about the supporting axle 42.

With continued reference to FIG. 1, another of the plurality of jewelry supporting components may include a ring support 30 as shown including at least two adjacent flexible strip pads 58 defining a flexible slot 60. Preferably, the ring support 30 includes at least three adjacent flexible strip pads 58 defining two flexible slots 60. In a preferred embodiment, the three adjacent flexible strip pads 58 are stepped in height to provide a stepped ring display.

Figure 3:
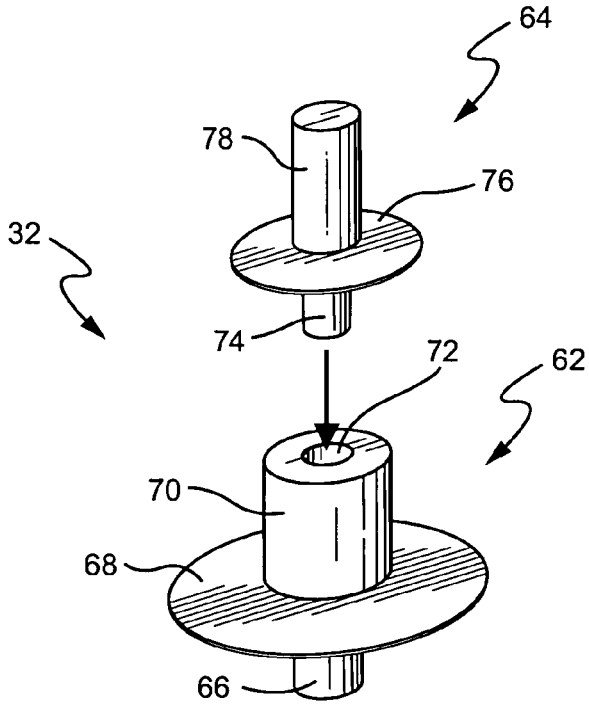
FIG. 3 is an assembly drawing of a ring tower for supporting a plurality of rings.

With reference to FIG. 3, still another of the plurality of jewelry supporting components within the cabinet 16 may also include a ring tower 32 including at least one post for receiving a ring or the like. Preferably, the ring tower 32 includes at least a stacked receiving component 62 and a top receiving component 64. The stacked receiving component 62 includes a supporting member 66 fixable either to the cabinet 16 or an adjacent stacked receiving component, a stacked ring platform 68, and a post 70 with an aperture 72 formed in a top thereof. The stacked ring platform 68 is preferably fitted to the post 70 in a friction fit and may be formed of a washer covered with a decorative material.

The top receiving component 64 includes a peg 74 shaped to fit in the post aperture 72 of an adjacent stacked receiving component 62, a top ring platform 76, and a respective post 78. The ring tower 32, of course, may include a plurality of the stacked receiving components 62, thereby providing multiple levels to separately display rings or like objects of the jewelry collection.

With continued reference to FIG. 1, the cabinet 16 and glass doors 12 may be provided with a lock assembly 80 such as a chain and padlock fitted around the glass door handles 14. Of course, those of ordinary skill in the art will appreciate alternative locking assemblies for the glass doors, and the invention is not meant to be limited to the illustrated example.

With the construction of the jewelry case and jewelry display assemblies of the present invention, a jewelry collection can be made part of an artistic display. Moreover, a number of novel jewelry supporting components facilitate the display and provide added artistic appeal.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A jewelry display case comprising:

a cabinet having at least a bottom, sides and a top; and a plurality of jewelry supporting components, at least one of the jewelry supporting components comprising a jewelry display assembly including:

a pair of sidewalls disposed spaced from each other in facing relation, a plurality of jewelry bars fixed to and extending between the sidewalls, the jewelry bars being spaced from one another and disposed about each periphery of the sidewalls such that an opposite side jewelry bar is viewable through the assembly, and a supporting axle extending through a center of each of the sidewalls, wherein the sidewalls and at least one jewelry bar are rotatable relative to the supporting axle, and wherein the supporting axle is fixed to one of the cabinet sides.

2. A jewelry display case according to claim 1, wherein the plurality of jewelry supporting components comprises a ring support including at least two adjacent flexible strip pads defining a flexible slot.

3. A jewelry display case according to claim 2, wherein the ring support comprises at least three adjacent flexible strip pads defining two flexible slots.

4. A jewelry display case according to claim 3, wherein the at least three adjacent flexible strip pads are stepped in height to provide a stepped ring display.

5. A jewelry display case according to claim 1, wherein the plurality of jewelry supporting components comprises a ring tower including at least one post for receiving a ring.

6. A jewelry display case according to claim 1, wherein the cabinet comprises glass doors.

7. A jewelry display case according to claim 6, further comprising a lock acting on the glass doors.

8. A jewelry display case according to claim 1, wherein the jewelry bars of the jewelry display assembly each comprise means for supporting at least one piece of jewelry.

9. A jewelry display case according to claim 8, wherein the supporting means comprises a plurality of apertures that are sized to receive earring posts.

10. A jewelry display case according to claim 1, wherein the jewelry display assembly further comprises a handle assembly secured to one of the sidewalls and over the supporting axle, the handle assembly effecting manual rotation of the axle.

11. A jewelry display case comprising:

a cabinet having at least a bottom, sides and a top; and a plurality of jewelry supporting components, at least one of the jewelry supporting components comprising a ring tower including at least one post for receiving a ring, wherein the ring tower comprises at least a stacked receiving component and a top receiving component, the stacked receiving component including a supporting member fixed to the cabinet and fixable to an adjacent stacked receiving component fixed to the cabinet, a stacked ring platform, and a post with an aperture formed in a top thereof, and the top receiving component including a peg shaped to fit in the post aperture of an adjacent stacked receiving component, a top ring platform, and a respective post.

12. A jewelry display case according to claim 11, wherein the ring tower comprises a plurality of stacked receiving components.

* * * * *